US006890053B2

(12) United States Patent
Myhill et al.

(10) Patent No.: US 6,890,053 B2
(45) Date of Patent: May 10, 2005

(54) POSITIVE AIR SYSTEM FOR INKJET PRINT HEAD

(75) Inventors: Gregory A. Myhill, Brookfield, CT (US); Charles S. Tamarin, New Rochelle, NY (US); Glen Vincent, Torrington, CT (US)

(73) Assignee: Illinois Tool Works, Inc., Glenview, IL (US)

( * ) Notice: Subject to any disclaimer, the term of this patent is extended or adjusted under 35 U.S.C. 154(b) by 0 days.

(21) Appl. No.: 10/401,822

(22) Filed: Mar. 28, 2003

(65) Prior Publication Data

US 2004/0189744 A1 Sep. 30, 2004

(51) Int. Cl.[7] ..... B41J 2/165
(52) U.S. Cl. ..... 347/25; 347/22
(58) Field of Search ..... 347/22, 24, 25, 347/82; 15/316.1, 405, 306.1; 239/566

(56) References Cited

U.S. PATENT DOCUMENTS

| | | | | |
|---|---|---|---|---|
| 4,411,706 | A | 10/1983 | Wallace et al. | |
| 4,418,355 | A | 11/1983 | DeYoung et al. | |
| 4,591,869 | A | 5/1986 | Katerberg et al. | |
| 4,875,054 | A | 10/1989 | Archer et al. | |
| 5,173,988 | A | * 12/1992 | Bhatia et al. | 15/309.2 |
| 5,519,420 | A | 5/1996 | Zorn et al. | |
| 6,491,364 | B2 | 12/2002 | Pierezyk et al. | |
| 2002/0089563 | A1 | 7/2002 | Tanaka | |

FOREIGN PATENT DOCUMENTS

| | | |
|---|---|---|
| GB | 2 370 249 A | 6/2002 |
| JP | 55146774 | 11/1980 |
| JP | 56038267 | 4/1981 |
| JP | 56038268 | 4/1981 |
| JP | 61164838 | 7/1986 |
| JP | 04334455 | 11/1992 |
| WO | WO 02/22371 A2 | 3/2002 |
| WO | WO 02/36347 A2 | 5/2002 |

OTHER PUBLICATIONS

European Search Report (Munich); Jun. 7, 2004 (3 pgs), Urbaniec, T.

* cited by examiner

*Primary Examiner*—Shih-Wen Hsieh
(74) *Attorney, Agent, or Firm*—Mark W. Croll, Esq.; Donald J. Breh, Esq.; Welsh & Katz, Ltd.

(57) ABSTRACT

A positive air system, for a fluid jetting device that jets a fluid in a fluid droplet path prevents the ingress of dust and debris to the fluid jetting device and further prevents the introduction of dust and debris into the fluid droplet path. The air system includes an enclosure having at least one wall defining a barrier and enclosing the fluid jetting device. The barrier defines a local environment. The at least one wall has a plurality of orifices formed therein that are configured to direct a stream of pressurized air therefrom in a direction that diverges from the fluid droplet path. The fluid droplet path and the pressurized air stream direction do not converge so that the pressurized air flowing from the orifices does not interfere with the fluid moving through the droplet path.

15 Claims, 8 Drawing Sheets

POSITIVE AIR SYSTEM FOR INKJET PRINT HEAD

BACKGROUND OF THE INVENTION

The present invention relates generally to air systems for fluid jet devices. More particularly, the present invention pertains to air systems to prevent debris from interfering with the proper operation of fluid jet devices, such as ink jet print systems.

Fluid jet devices are in wide spread use. One particular use for such devices is in ink jet printers. There area number of principle types of ink jet printers. One type of printer relies upon capillary action to move a working fluid (e.g., ink) to the print head. The ink is directed from the print head through one or more orifices toward a target substrate. Ink jet printers include an actuator for urging the ink through the orifice. Actuators can include piezzo electric elements, thermal devices and the like. An exemplary ink jet print head is disclosed in DeYoung et al., U.S. Pat. No. 4,418,355.

The ink is ejected from the print head as a droplet of fluid. These droplets are extremely small in volume and mass. In that many such operations are carried out in commercial or industrial environments the processes are potentially subjected to dust and debris. For example, the printing is often applied to boxes or other shipping containers carried on a conveyor or line within a manufacturing facility. To this end, the potential for dust and debris to disrupt or interfere with the printing operation is quite high.

A number of devices, configurations and methods have been proposed and are used to prevent the introduction of dirt and debris to the inkjet print head and into the ink droplet path. For example, air knives, air curtains, blow off nozzles and air blankets are designed to alleviate dust and debris around the print heads. However, these devices are manufactured as part of the print head. As such, they are relatively costly, and cannot be retrofitted to existing inkjet system.

Moreover known systems typically operate at high pressures, on the order of about 30 to 80 pounds per square inch (psi). Even the known lower pressure system, generally operate at pressures of about 30 psi or greater. These high pressure systems can adversely effect printing by action of the high pressure air interfering with the ink droplet pattern.

Accordingly, there exists a need for an air system for inkjetting devices that reduces the potential for dust and debris interfering with the jetting pattern. Desirably, such a system effectively forces debris from an article that is to have the jetted fluid applied thereto. More desirably, such a system effectively envelopes the environment around the jetted fluid to prevent the ingress of outside dust and debris into the local environment. Most desirably, such a system minimally, if at all, adversely interferes with the jetted fluid.

BRIEF SUMMARY OF THE INVENTION

A positive air system, for a fluid jetting device that jets a fluid in a fluid droplet path prevents the ingress of dust and debris to the fluid jetting device and further prevents the introduction of dust and debris into the fluid droplet path.

The air system is configured to reduce the potential for dust and debris interfering with the jetting pattern. The system further forces debris from an article that is to have the jetted fluid applied thereto. Such a system provides an envelope of the local print head environment and around the jetted fluid to prevent the ingress of outside dust and debris into the local environment.

Importantly, the system minimally, if at all, adversely interferes with the jetted fluid. The system includes at least one wall that defines a barrier and encloses the fluid jetting device. The barrier defines the local environment. Preferably, the barrier is defined by three or four walls around the print head.

The wall has a plurality of orifices formed therein that are configured to direct a stream of pressurized air therefrom in a direction that diverges from the fluid droplet path. That is, the fluid droplet path and the pressurized air stream direction do not converge so that the pressurized air flowing from the orifices does not interfere with the fluid moving through the droplet path.

The barrier or enclosure can be formed as includes three walls defining an upper wall and a pair of opposing side walls. In one embodiment, the walls each include a primary air branch that divides into secondary air branches that divide into tertiary air branches that in turn terminate at orifice branches. The air branches are configured so as to provide a substantially equal pressure drop from the primary air branch to each of the orifices.

To further assure a balanced air flow and pressure at the orifices, one or more restrictors can be positioned in the air branches to provide the substantially equal pressure drop. Diverters can also be positioned within the air branches to direct air into the branches.

Preferably, the walls are oriented at an angle to the fluid drop path so that air that is deflected from an object onto which the fluid is jetted, is deflected away from the fluid jetting device.

Alternately, the positive air system includes an air knife having a pressurized air reservoir. An air inlet provides air to the reservoir and a restricted pressurized air outlet provides an exit for the air. The air outlet is formed to direct a stream of pressurized air therefrom in a direction that diverges from the fluid droplet path. In this manner, the fluid droplet path and the pressurized air stream direction do not converge. The pressurized air flowing from the outlet prevents the ingress of dust and debris to the fluid jetting device and further prevents the introduction of dust and debris into the fluid droplet path, and wherein the pressurized air flowing from the orifices does not interfere with the fluid moving through the droplet path.

In this embodiment, the outlet can be formed as a plurality of orifices. Alternately, the outlet can be formed as an elongated orifice-like slot. The air knife can be formed having a body and including a cover and a spacer disposed between the cover and the body. In this arrangement, the spacer defines a slot forming the air outlet.

Alternately, the system includes an enclosure for the fluid jetting device that defines a local environment and an air flow path. An air supply supplies air into the local environment to maintain the enclosure at a pressure greater than the pressure of an environment outside of the local environment. The air supply is configured so as to not interfere with the droplets. A pressure relief device can be used for relieving air pressure from the enclosure when the pressure exceeds a predetermined value.

These and other features and advantages of the present invention will be apparent from the following detailed description, in conjunction with the appended claims.

BRIEF DESCRIPTION OF THE SEVERAL VIEWS OF THE DRAWINGS

The benefits and advantages of the present invention will become more readily apparent to those of ordinary skill in the relevant art after reviewing the following detailed description and accompanying drawings, wherein.

DETAILED DESCRIPTION OF THE INVENTION

Figure 1:
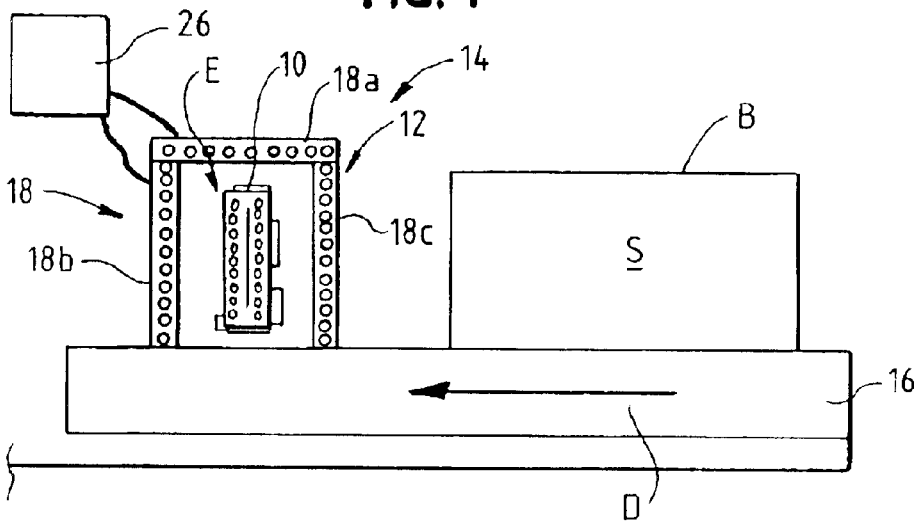
FIG. 1 is a schematic illustration of a front view of one embodiment of a positive air system for an ink jet print head in accordance with the principles of the present invention, the system being shown with a box approaching the print head.

While the present invention is susceptible of embodiment in various forms, there is shown in the drawings and will hereinafter be described a presently preferred embodiment with the understanding that the present disclosure is to be considered an exemplification of the invention and is not intended to limit the invention to the specific embodiment illustrated.

It should be further understood that the title of this section of this specification, namely, "Detailed Description Of The Invention", relates to a requirement of the United States Patent Office, and does not imply, nor should be inferred to limit the subject matter disclosed herein.

All patents referred to herein, are hereby incorporated herein by reference, whether or not specifically do so within the text of this disclosure.

In the present disclosure, the words "a" or "an" are to be taken to include both the singular and the plural. Conversely, any reference to plural items shall, where appropriate, include the singular.

Figure 2:
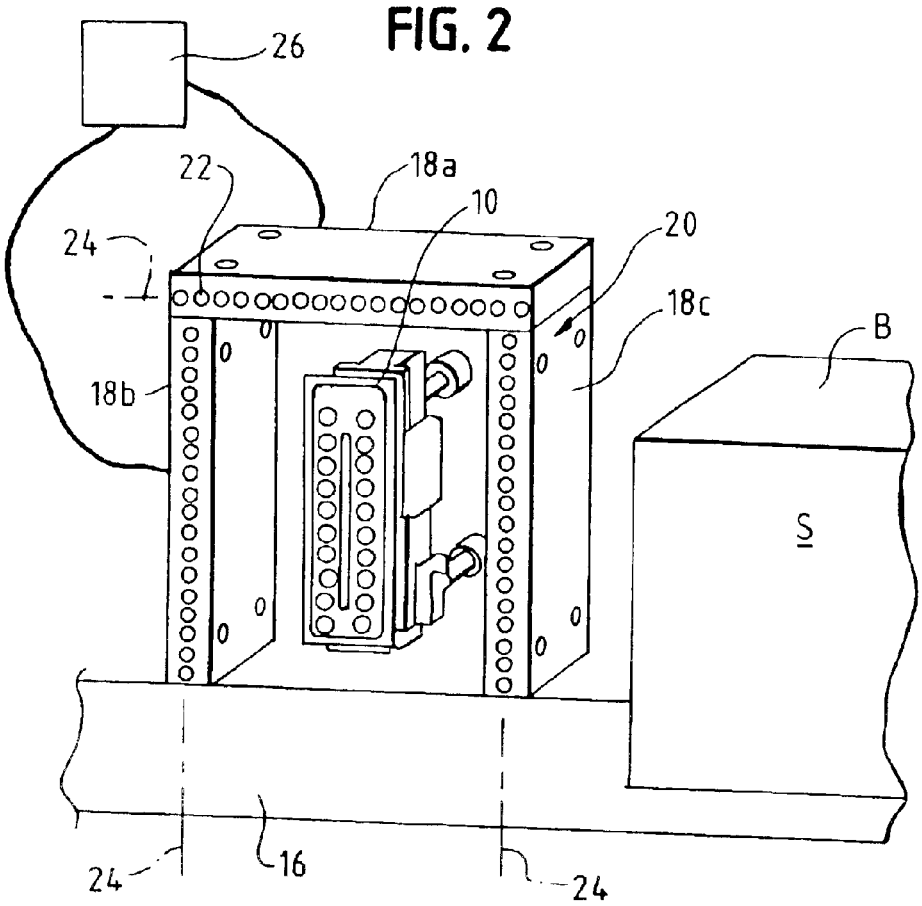
FIG. 2 is a perspective front view of the positive air system.

Referring now to the figures and in particular to FIGS. 1 and 2, there is shown a print head, for example, an ink jet print head having a positive air system 12 in accordance with the principles of the present invention. The positive air system 12 reduces the potential for dust and debris interfering with the print head jetting pattern and reduces the potential for dust and debris fouling the print head 10. The system 12 effectively envelopes the environment E around the jetted fluid to prevent the ingress of dust and debris to the local environment E, and minimally, if at all, interferes with the pattern of the jetted fluid.

In a very basic form, a printing system 14 includes a conveyor 16 along which boxes B or the like are conveyed past the print head 10. The print head 10 jets a fluid, such as ink, onto the box B to, for example, provide a bar code, a description of the package contents, a mailing address, or the like. Those skilled in the art will recognize the various arrangements by which a print head is mounted near a conveyor for such.

The air system 12, as shown in FIGS. 1 and 2 includes air knives or air curtains 18, to define an enclosure 20 around the print head 10. As illustrated, three air knives 18 are positioned such that, along with the conveyor 16, they envelope the print head 10. Each air knife 18 is formed as a wall 19 having a plurality of orifices 22, formed in a linear array 24, through which air is exhausted or vented. As illustrated, one air knife 18 is positioned above the print head 10 (air knife 18*a*), with the array 24 generally parallel to the direction D of conveyance of the box B. A pair of opposing knives 18*b*, 18*c* are positioned on either side of the print head 10, with their respective arrays 24 generally perpendicular to the direction D of conveyance of the box B. An air supply 26 supplies clean, debris-free air to the air knives.

Figure 3:
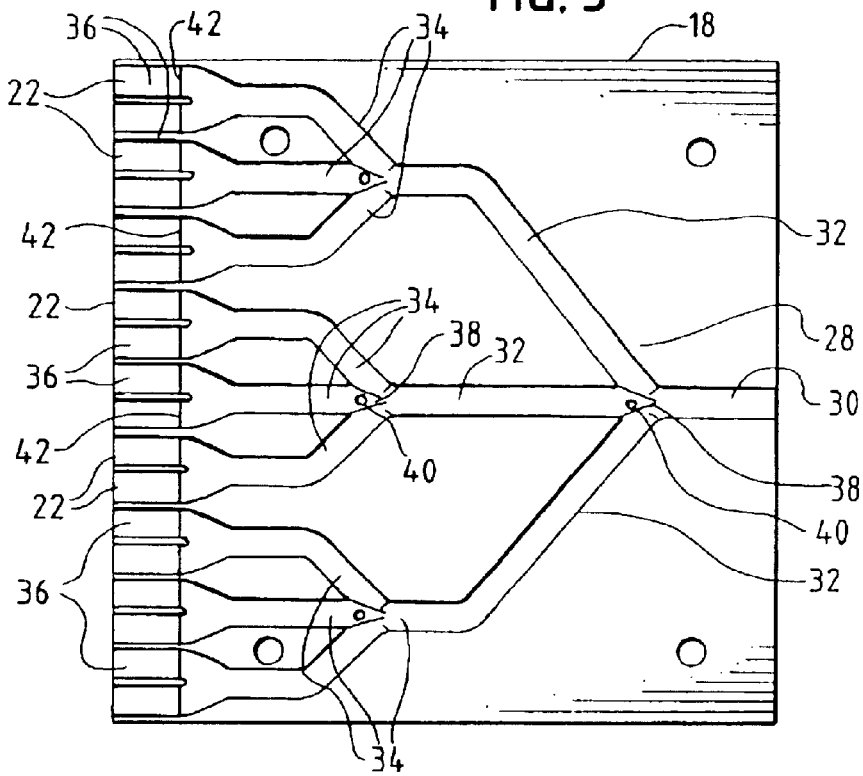
FIG. 3 is a cross-section of an exemplary air curtain taken along line 3—3 of FIG. 1.

Referring now to FIG. 3, there is shown a cross-sectional view of an exemplary air knife 18. One of the novel features of the present positive air system 12 is the ability to maintain the "cleanliness" of the environment enveloping the print head; that is, the area between the print head and the boundaries defined by the air knives 18*a,b,c*, e.g., the local environment E. The present positive air system 12-controls this environment, i.e., maintains a positive pressure to reduce or eliminate the ingress of dust and debris, while at the same time, preventing interference with the fluid jetting patterns.

An air path 28 is formed in each knife 18 that branches from a main or common branch 30 to each of the orifices 22. The path 28 is configured such that the pressure drop (or the ultimate pressure) at each orifice 22 is equal to the pressure at each other orifice 22. In this manner, there are no unaccounted for, or undetermined, air flow patterns. Rather, by balancing the pressure drop, the air flow pattern is predictable so as to prevent interference with the fluid jet pattern. In a present air knife 18, the primary branch 30 is divided into three secondary branches 32. Each of the secondary branches 32 is further divided into three tertiary branches 34 which in turn are divided into paired orifice feed branches 36.

Each of the orifice feed branches 36 is about the same length as each other orifice feed branch 36. As such, the pressure drop across each of the orifice feed branches 36 is about equal as well. However, the secondary 32 and tertiary branches 34 are not of equal length; thus, the pressure drop could differ between branches (that is among the secondary branches 32 or among the tertiary branches 34). In order to assure that the pressure drop across each of the branches 32, 34 is about equal, a diverter 38 is positioned at about the branch 32 or 34 junctures. In this manner, the diverter directs or diverts air flow into the various branches 32 and 34 to effect an equal pressure drop (and thus outlet pressure) at each of the orifices 22.

In addition to the diverters 38, a pin 40 can be positioned at the entrance to each of the shortest of the secondary 32 and tertiary 34 branches . The pin 40 further assists in balancing the pressure drops through the various branches to effect a balanced pressure at the orifices 22.

Optionally, a restrictor such as that indicated at 42, can be positioned at about each of the orifices 22. The restrictor 42 is configured so as to assist in effecting an equal pressure drop (e.g., equal pressure at the orifices), and to further limit the velocity and pressure of the air exiting the orifices. Unlike known positive pressure systems which use relatively high air pressures, the present system 12 uses air at a pressure of about 1 psig to about 5 psig. It has been found that an air pressure of about 1 psig is advantageous over known high pressure systems in that the air pressure is sufficiently low so that there is little to no adverse effect on the jetted fluid. That is, the air does not move the jetted fluid from the path that the fluid would other traverse toward the media (e.g., box B) onto which it is applied.

Figure 4:
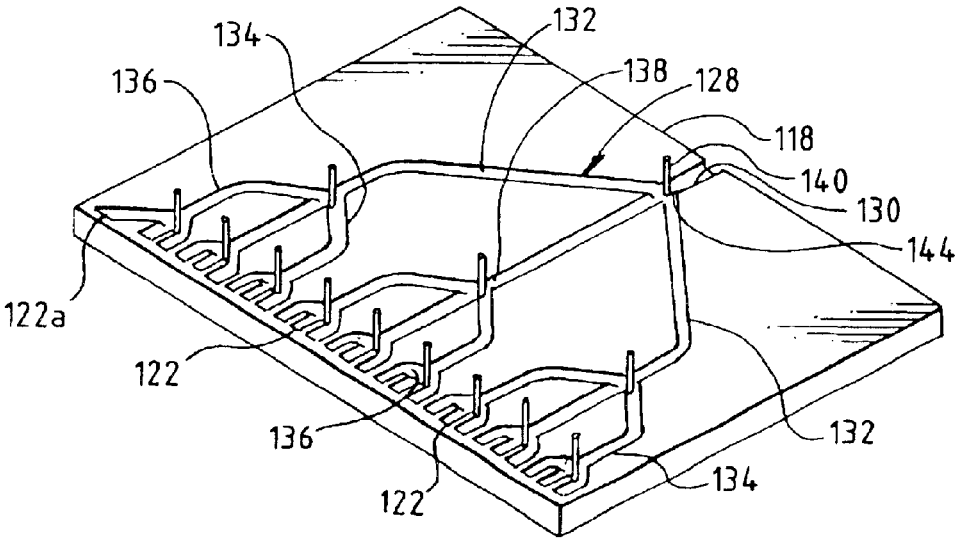
FIG. 4 is a cross-section of an alternate air curtain configuration.
Figure 5:
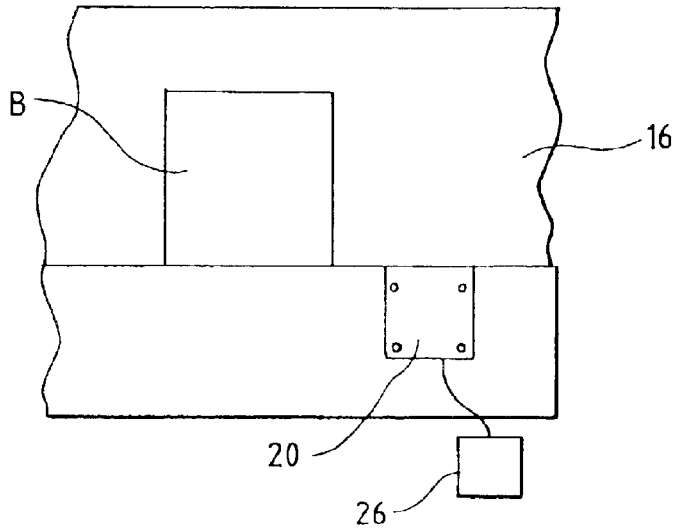
FIG. 5 is a top view of the positive air system of FIG. 1.
Figure 6:
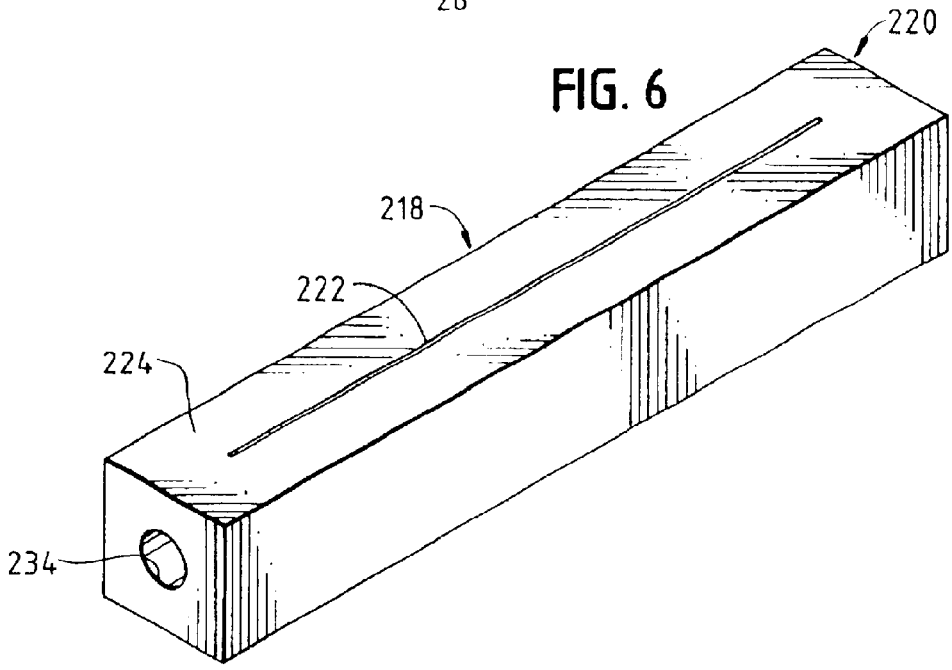
FIG. 6 is perspective view of an alternate embodiment of an air knife embodying the principles of the present invention.

An alternate embodiment of an air path 128 for an air knife 18 is shown in FIG. 4. In this embodiment, the air path 128 is formed different from that of the embodiment 28 in FIG. 3. The path 128 includes a main or primary branch 130 that divides into three secondary branches 132. Each of the three secondary branches 132 in turn divides into three tertiary branches 134 which in turn divide into three orifice feed branches 136. Again, pins 140, diverters 138 and restrictors 142 can be used (if desired) to facilitate the balancing or equalizing or air pressure at each of the orifices 122. Additionally, a restriction 144 (as a decrease in diameter or a restrictor) can be formed at about the primary branch 130 to further facilitate pressure balancing.

As seen in FIG. 4, the orifices 122*a* at about the edge of the knife 118 can be angled outward. In this manner (because the knives 118 are angled outward and/or upward relative to the print head 10, as best seen in FIGS. 10–13), any gaps in air flow that may otherwise occur at the "corners" where the upper and side knives meet, are "filled".

Still other embodiments of the air knife or air curtain are shown in FIGS. 6–9. In these embodiments, rather than a plurality of pathways, a relatively large, contained chamber 220 provides a pressurized air reservoir 223. Air is directed out of the,reservoir 223 through a plurality of small orifice-like openings 222 in the body of the chamber 220 (FIG. 6), or through an elongated, narrow orifice-like slot 228 in the chamber 220 or in a cover plate 226 (FIG. 8) for the chamber 220, overlying the reservoir 223.

Figure 9:
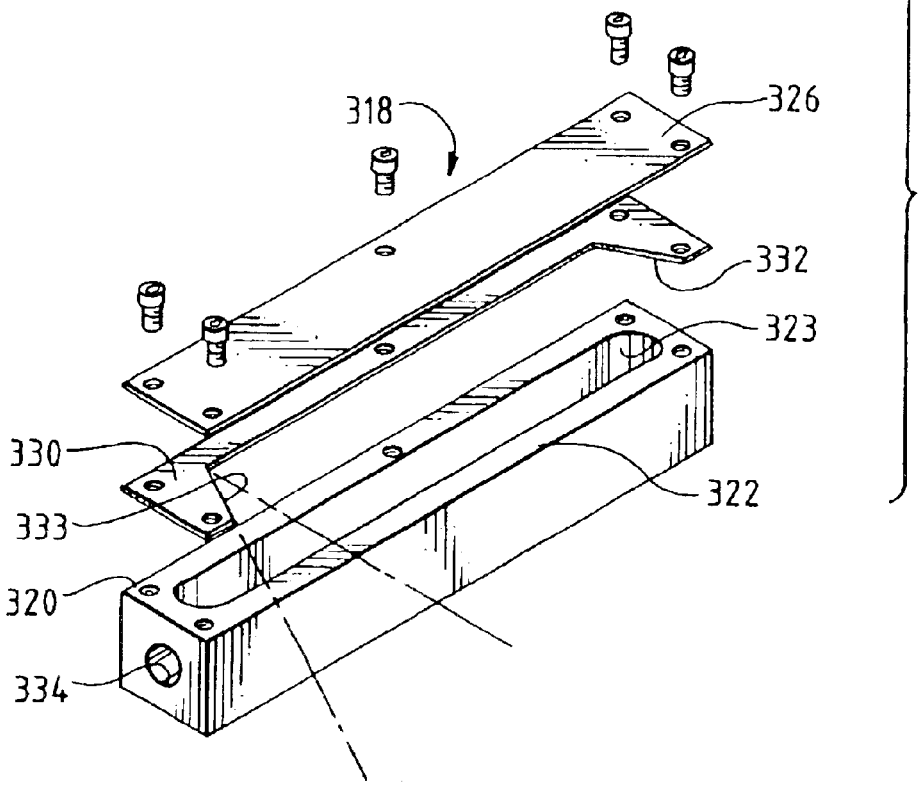
FIG. 9 is a perspective view of yet another alternate embodiment of an air knife.

In still another embodiment 318 as seen in FIG. 9, a thin spacer plate 330 (about 1/1000 inch or 1 mil) having a notched or etched portion 332 is positioned between the chamber body 320 and the cover plate 326. The notch 332 is open to the reservoir 323 so that air exits the reservoir 323 from between the chamber body 320 and the cover plate 326 through the an elongated orifice-like slot 322 that is defined by the notch 332. This arrangement provides a continuous restricted flow path or continuous restriction, and as such, provides for a controlled flow (and pressure) along the length of the slot 322.

Figure 7:
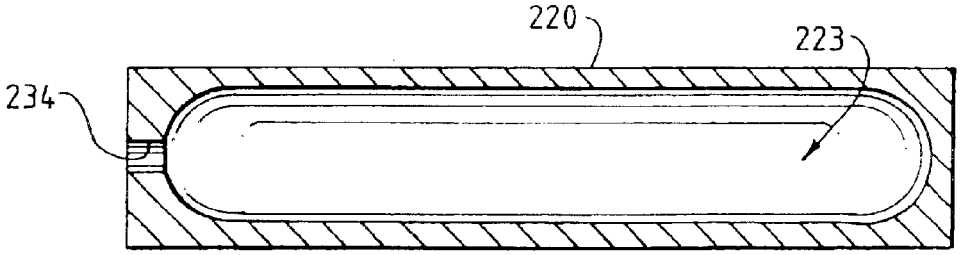
FIG. 7 is a cross-section of the air knife of FIG. 6 taken along line 7—7 of FIG. 6.
Figure 8:
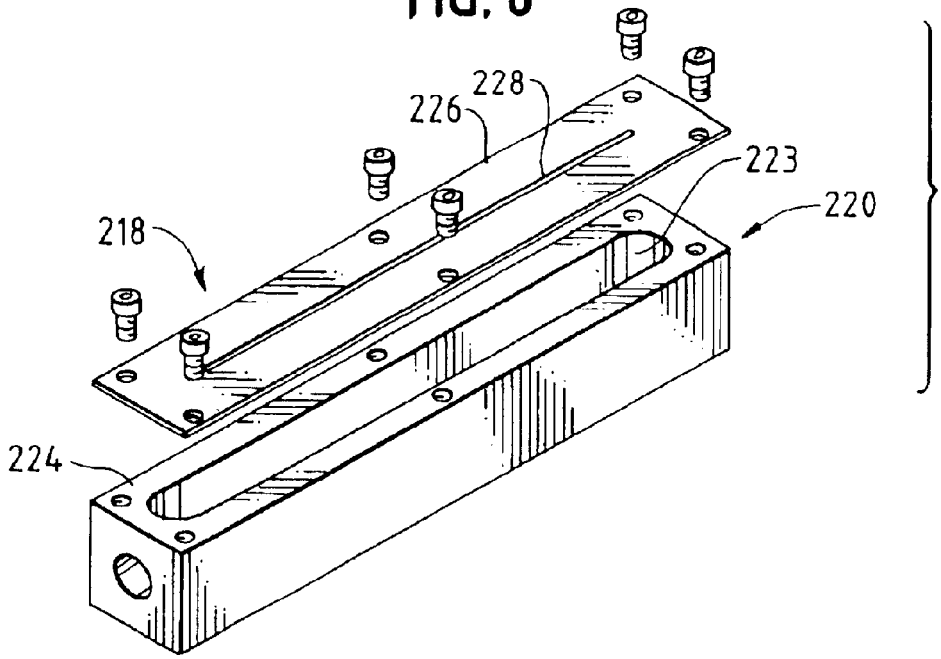
FIG. 8 is a perspective view of a still another alternate embodiment of an air knife.

An exemplary cross-section of the air knife embodiments 218, 318 is illustrated in FIG. 7. As can be seen, an entrance 234, 334 to the reservoir 223, 323, formed in the chamber body 220, 320 is relatively small (thus defining a restriction) compared to the size of the reservoir 223, 323. As such the pressure drop at any of the orifices 222 is about equal to the pressure drop at any of the other orifices 222 and, likewise, the pressure drop at any location along the elongated slot 228, 322 is about equal to the pressure drop at any other location along the slot 228, 322.

Similar to the angled orifices 122*a* of the embodiment 118 illustrated in FIG. 4, the spacer plate 330 can have an angled edge (as indicated at 333) to direct air outwardly, at an angle, to account for the angled orientation of the knives 318. This prevents "gaps" at the corners or junctures of the upper and side knives 318.

Figure 10:
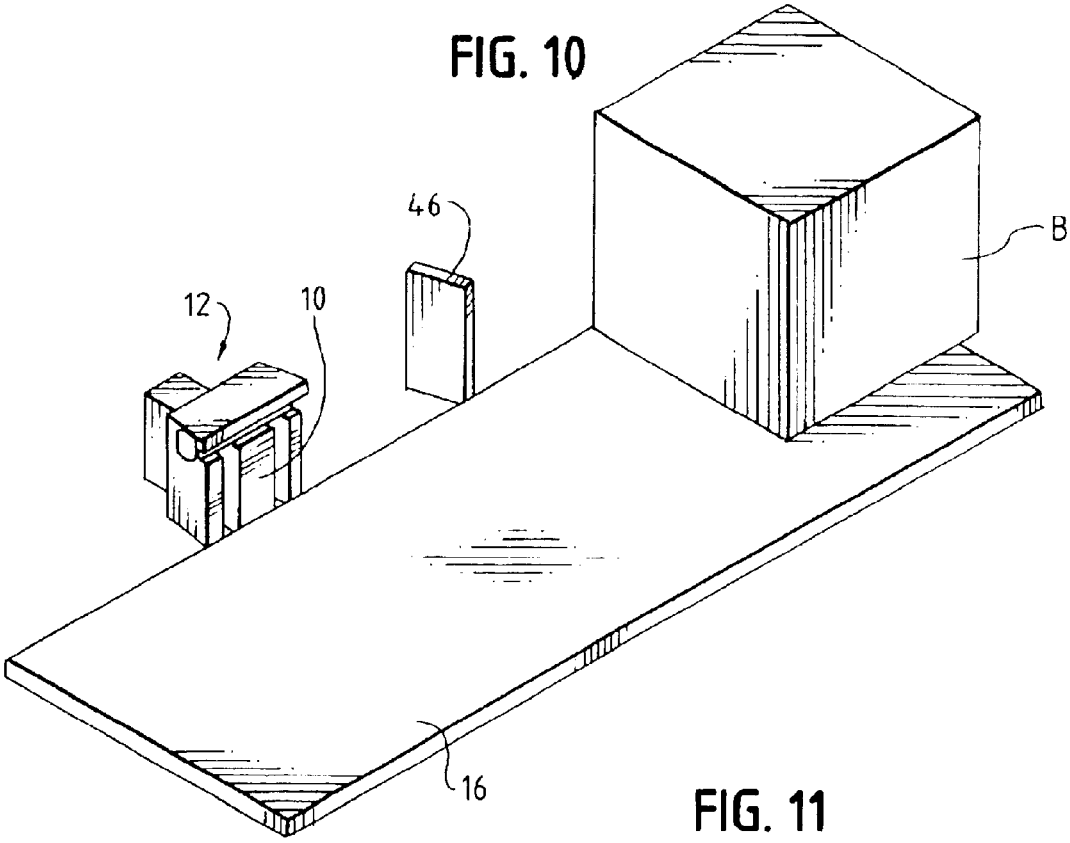
FIG. 10 is a schematic illustration of the positive air system of FIGS. 1–4 shown with an optional pre-cleaning air knife.
Figure 11:
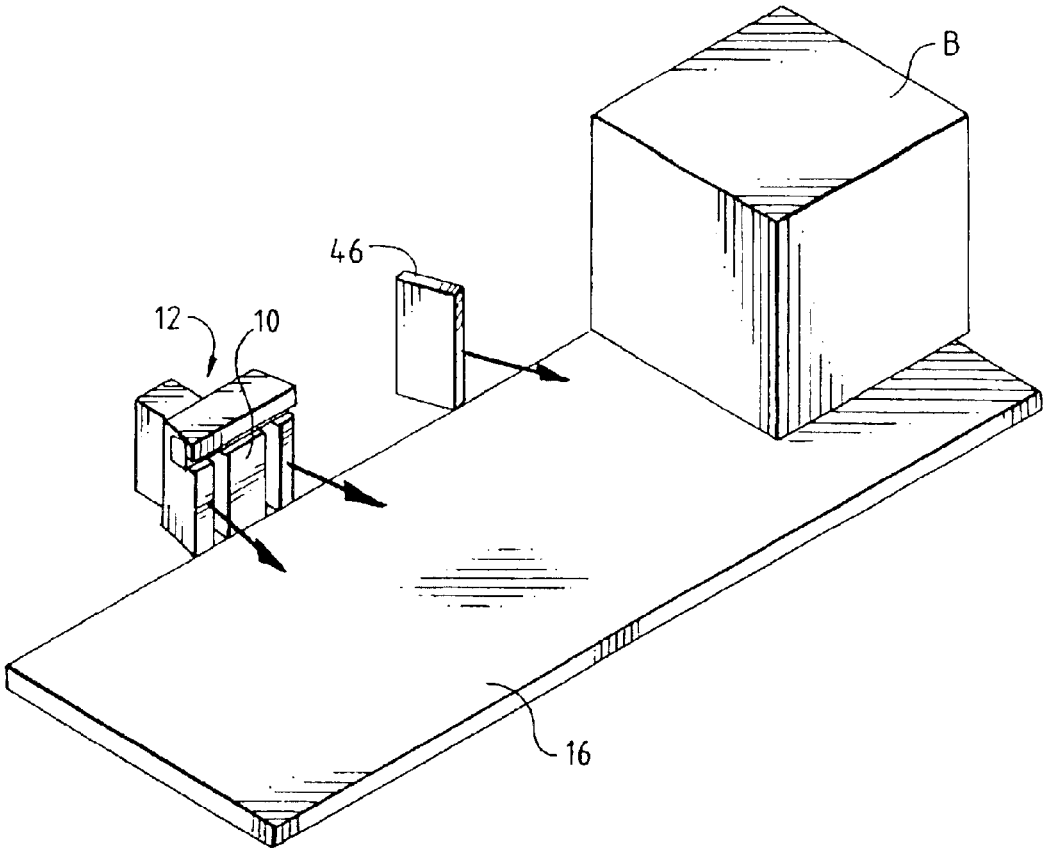
FIG. 11 is an air flow pattern diagram of the air system of FIG. 10 as the box approaches the print head.
Figure 12:
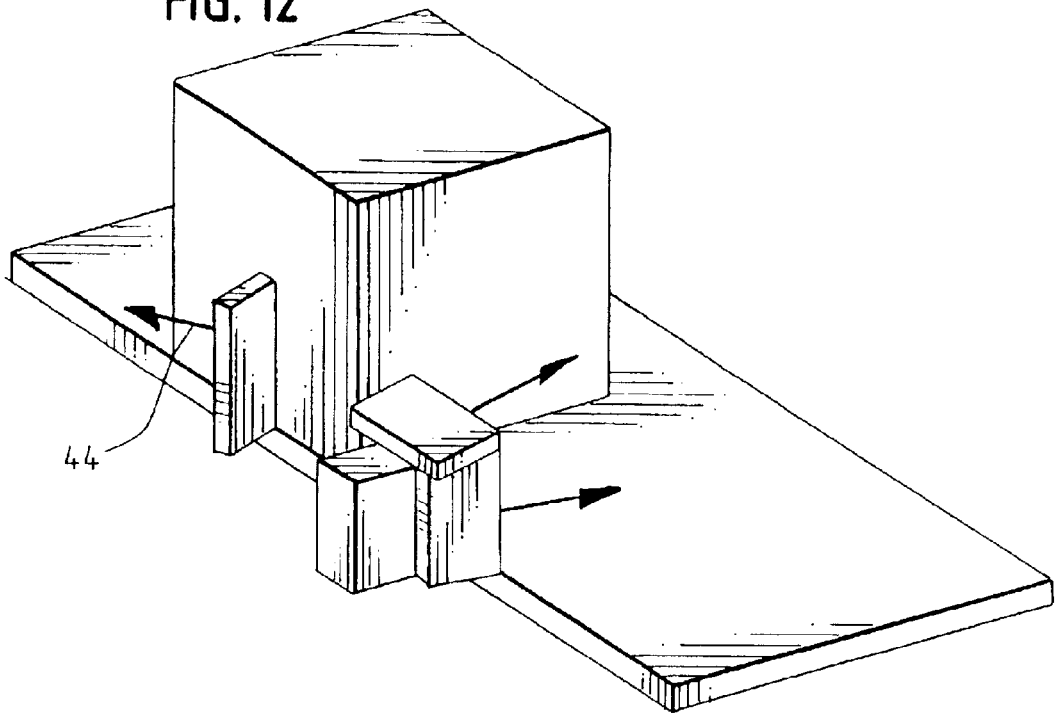
FIG. 12 is a rear perspective view of the air flow pattern diagram of FIGS. 10–11 as the box passes in front of the pre-cleaning knife.
Figure 13:
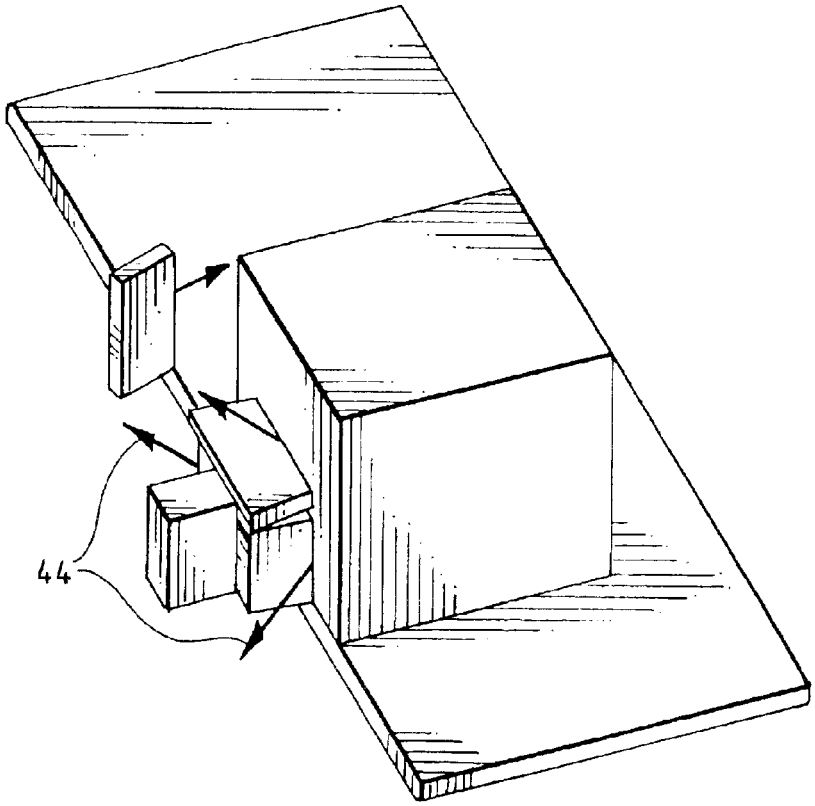
FIG. 13 is a top perspective view of the air flow pattern diagram of FIGS. 10–12 as box passes in front of the print head.
Figure 14:
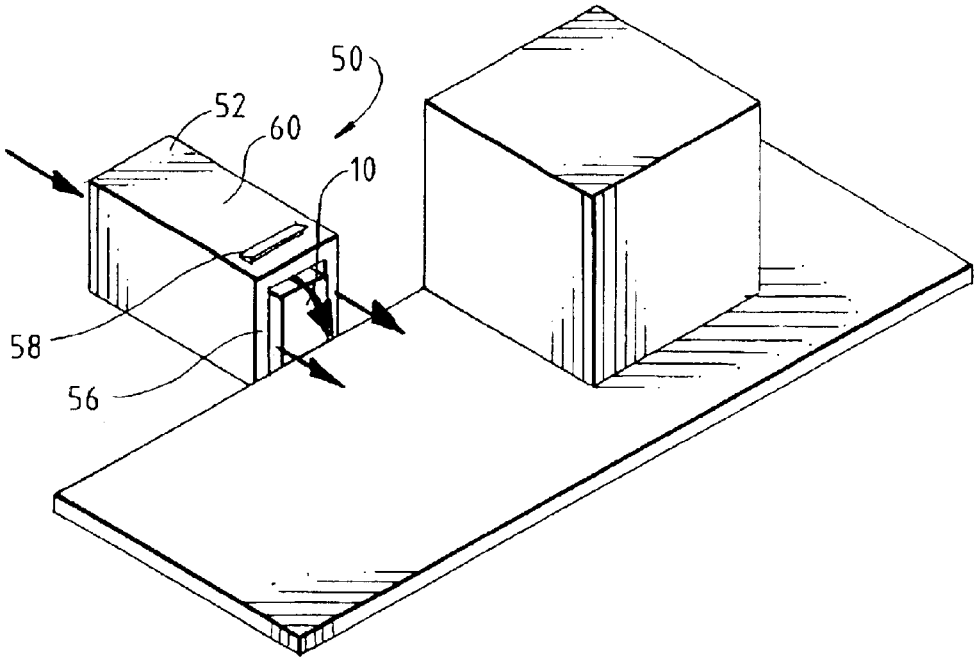
FIG. 14 is a schematic illustration of an alternate embodiment of a positive air system that includes a positive air enclosure, embodying the principles of the present invention illustrated with a box as the box approaches the print head.

In conjunction with the novel use of a low pressure system, as seen in FIG. 10, the present positive air system 12 uses angled curtains or knives 18 to facilitate directing the deflected air away (indicated by the arrow at 44 in FIG. 8) from the print head 10. That is, rather than the orifices 22, 122, 222 (or slots 228, 322) directing air perpendicular to the box surface S onto which the indicia is printed, the orifices 22, 122, 222 (or slots 228, 322) direct the air at an angle relative to the surface S. In this manner, the air that deflects off of the surface S is directed away from the print head 10, rather than toward the print head 10. It has been observed that this arrangement blows the dust and debris away from the local environment E to maintain the print head 10 and environment E contaminant free. This arrangement also prevents the formation of eddy currents within the local environment E (e.g., immediately around the print head 10), that could otherwise adversely impact the fluid droplet path.

Also as seen in FIGS. 10–13, the positive air system 12 can include a supplemental box cleaner knife 46 positioned upstream of the print head 10 and its associated knives/curtains 18, 118, 218, 318. This supplemental knife 46 facilitates maintaining the local environment E contaminant-free by removing any dust or debris that may be present on the box B before the box B is presented at the print head 10.

Figure 15:
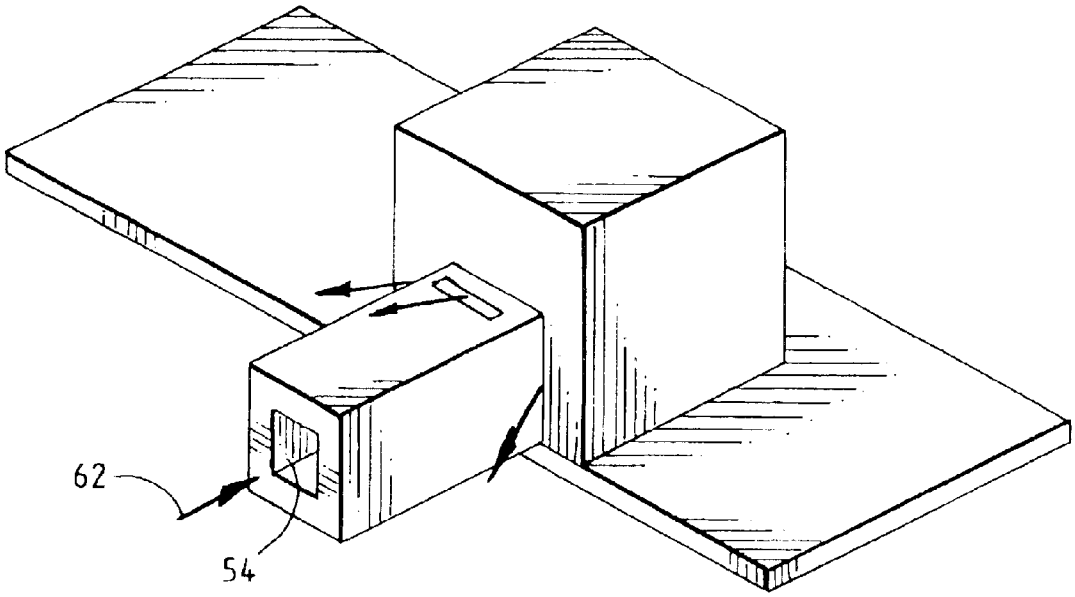
FIG. 15 is a rear perspective view of the air flow pattern diagram of FIG. 14 as the box passes in front of the print head.
Figure 16:
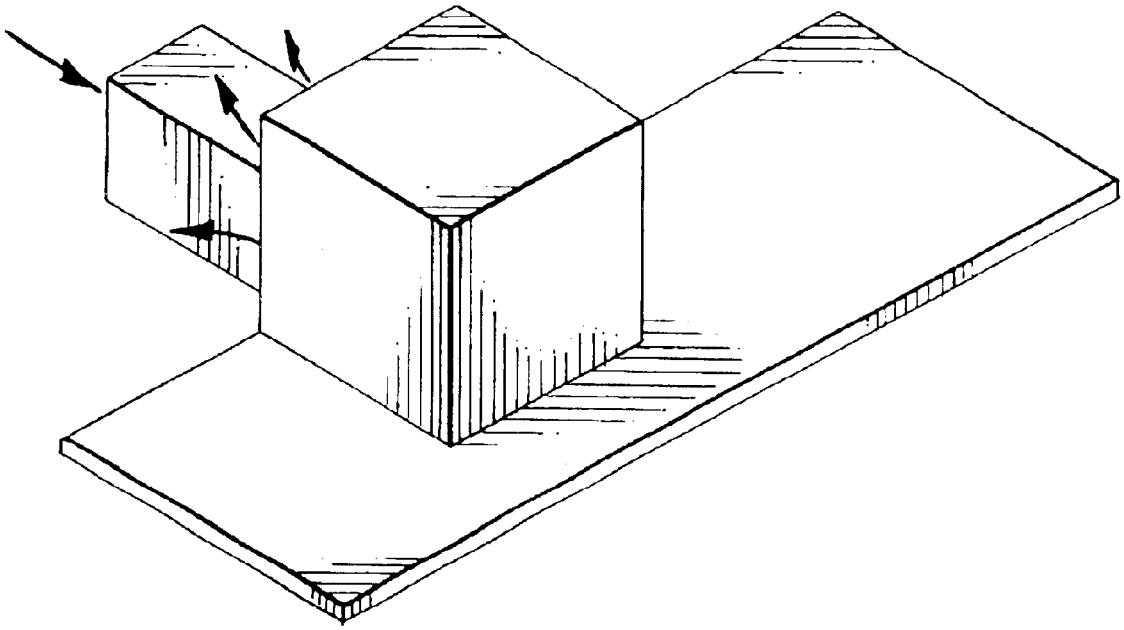
FIG. 16 is a front perspective view of the air flow pattern diagram, similar to FIG. 15, as the box passes in front of the print head.

An alternate embodiment of the positive air system 50 is illustrated in FIGS. 15–16. In this embodiment, the print head 10 is disposed within an enclosure 52 that essentially forms a tunnel 54. As such, the air flows through the tunnel 54, including around the print head 10, and out a forward end 56 of the tunnel, past the print head 10.

To prevent over-pressurization of the tunnel 54, as when the box B moves passed the tunnel front 56, a flapper valve 58 is positioned in one of the enclosure walls 60 that provides communication between the tunnel 54 and the outside environment. The flapper valve 58 is closed during normal operation, thus isolating all but the tunnel front 56. When a box B passes in front of the tunnel 54, moving passed the print head 10, the flapper valve 58 opens to relieve any pressure increase in the tunnel 54. In this manner, the air that is supplied through the tunnel 54 does not adversely effect the operation of the print head 10 (i.e., effect the fluid droplet path). Again, air is supplied from a clean, debris-free air supply 62.

From the foregoing it will be observed that numerous modifications and variations can be effectuated without departing from the true spirit and scope of the novel concepts of the present invention. It is to be understood that no limitation with respect to the specific embodiments illustrated is intended or should be inferred. The disclosure is intended to cover by the appended claims all such modifications as fall within the scope of the claims.

What is claimed is:

1. A positive air system, for a fluid jetting device, the fluid jetting device configured to jet a fluid therefrom in a fluid droplet path, the positive air system comprising:

an enclosure having at least one wall defining a barrier and enclosing the fluid jetting device, the barrier defining a local environment, the at least one wall having a plurality of orifices formed therein, the orifices configured to direct a stream of pressurized air therefrom in a direction that diverges from the fluid droplet path such that the fluid droplet path and the pressurized air stream direction do not converge, wherein the pressurized air flowing from the orifices prevents the ingress of dust and debris to the fluid jetting device and further prevents the introduction of dust and debris into the fluid droplet path, and wherein the pressurized air flowing from the orifices does not interfere with the fluid moving through the droplet path.

2. The positive air system in accordance with claim 1 wherein the enclosure includes three walls defining an upper wall and a pair of opposing side walls.

3. The positive air system in accordance with claim 1 wherein the at least one wall includes a primary air branch dividing into secondary air branches, the secondary air branches dividing into tertiary air branches, the tertiary air branches dividing terminating at orifice branches, and wherein the air branches are configured so as to provide a substantially equal pressure drop from the primary air branch to each of the orifices.

4. The positive air system in accordance with claim 3 including one or more restrictors in the air branches to provide the substantially equal pressure drop.

5. The positive air system in accordance with claim 3 including one or more diverters within the air branches to direct air into the branches.

6. The positive air system in accordance with claim 3 including one primary air branch, three secondary air branches extending from the primary air branch and three tertiary air branches extending from each of the secondary air branches, each of the tertiary air branches terminating in a pair of orifice branches.

7. The positive air system in accordance with claim 1 wherein the at least one wall is oriented at an angle to the fluid drop path so that air that is deflected from an object onto which the fluid is jetted, is deflected away from the fluid jetting device.

8. The positive air system in accordance with claim 1 wherein outermost orifices are angled outwardly.

9. A dust and debris-free fluid jetting system comprising:

a fluid jetting device for jetting a fluid therefrom in a plurality of droplets, the plurality of droplets being jetted in a path;

an enclosure for the fluid jetting device defining a local environment, the enclosure defining an air flow path;

an air supply for supplying air into the local environment to maintain the enclosure at a pressure greater than a pressure of an environment outside of the local environment, the air supply configured so as to not interfere with the droplets; and a pressure relief device for relieving air pressure from the enclosure when the pressure exceeds a predetermined value.

10. The dust and debris-free fluid jetting system in accordance with claim 9 wherein the enclosure is formed having at least one wall having a plurality of orifices formed therein, the orifices configured to direct a stream of pressurized air therefrom in a direction that diverges from the fluid droplet path such that the fluid droplet path and the pressurized air stream direction do not converge and wherein the pressurized air flowing from the orifices prevents the ingress of dust and debris to the fluid jetting device and further prevents the introduction of dust and debris into the fluid droplet path, and wherein the pressurized air flowing from the orifices does not interfere with the fluid moving through the droplet path.

11. A positive air system, for a fluid jetting device, the fluid jetting device configured to jet a fluid therefrom in a fluid droplet path, the positive air system comprising:

an air knife having a pressurized air reservoir having a pressurized air inlet and having a restricted pressurized air outlet, the air outlet formed therein as a plurality of orifices to direct a stream of pressurized air therefrom in a direction that diverges from the fluid droplet path such that the fluid droplet path and the pressurized air stream direction do not converge, wherein the pressurized air flowing from the outlet prevents the ingress of dust and debris to the fluid jetting device and further prevents the introduction of dust and debris into the fluid droplet path, and wherein the pressurized air flowing from the orifices does not interfere with the fluid moving through the droplet path.

12. The positive air system in accordance with claim 11 wherein the outlet is formed as an elongated orifice-like slot.

13. The positive air system in accordance with claim 11 wherein the air knife has a body and includes a cover and a spacer disposed between the cover and the body, the spacer defining a slot forming the air outlet.

14. The positive air system in accordance with claim 13 wherein the slot is formed as an elongated orifice-like slot.

15. The positive air system in accordance with claim 13 wherein the spacer has an outwardly angled inner edge.

* * * * *